US006378533B1

(12) United States Patent
Roman

(10) Patent No.: US 6,378,533 B1
(45) Date of Patent: Apr. 30, 2002

(54) COSMETIC JAR WITH PIVOTABLE PULL-OUT STORAGE DEVICE

(75) Inventor: Scott C. Roman, Smithtown, NY (US)

(73) Assignee: Augros, Inc., Ronkonkoma, NY (US)

( * ) Notice: Subject to any disclaimer, the term of this patent is extended or adjusted under 35 U.S.C. 154(b) by 0 days.

(21) Appl. No.: 09/686,160

(22) Filed: Oct. 11, 2000

(51) Int. Cl.[7] ..... A45D 33/22
(52) U.S. Cl. ..... 132/295; 220/4.27
(58) Field of Search ..... 132/295, 294, 132/297, 300; 206/581; D28/78, 82; 220/4.27

(56) References Cited

U.S. PATENT DOCUMENTS

| | | | | | |
|---|---|---|---|---|---|
| 1,342,116 | A | * | 6/1920 | Kendall | 132/295 |
| 1,460,950 | A | * | 7/1923 | Denney | 132/295 |
| 1,813,281 | A | | 7/1931 | Davis | |
| 2,429,290 | A | * | 10/1947 | Mueller | 220/4.27 |
| 2,737,189 | A | | 3/1956 | Morningstar et al. | 132/83 |
| 3,392,868 | A | * | 7/1968 | Pfrommer | 220/4.27 |
| 4,586,519 | A | | 5/1986 | Seidler et al. | |
| 4,807,773 | A | * | 2/1989 | Tsai | 220/4.27 |
| 5,054,505 | A | | 10/1991 | Yuhara | 132/294 |
| 5,398,706 | A | | 3/1995 | Epstein | 132/294 |
| 5,669,400 | A | | 9/1997 | Sheffler et al. | 132/295 |
| 5,836,319 | A | | 11/1998 | Lombardi | 132/287 |
| 5,884,636 | A | | 3/1999 | Sheffler et al. | 132/295 |
| 6,041,935 | A | * | 3/2000 | Yang | 296/581 |
| 6,070,749 | A | * | 6/2000 | Joulia | 132/294 |
| 6,145,515 | A | * | 11/2000 | Wu | 220/4.27 |

FOREIGN PATENT DOCUMENTS

| | | | | |
|---|---|---|---|---|
| FR | 687518 | * | 8/1930 | 132/295 |
| GB | 1212209 | * | 11/1970 | 132/295 |

* cited by examiner

*Primary Examiner*—Todd E. Manahan
(74) *Attorney, Agent, or Firm*—Steinberg & Raskin, P.C.

(57) ABSTRACT

A cosmetic jar and applicator storage device which in a single unit provides a consumer with a cosmetic, and applicator and a mirror therefore. The cosmetic jar comprising, a cylindrical body having a first cosmetic storage section and a second applicator storage section, the first section being structured and arranged to accommodate a cosmetic such as a pressed powder or the like and adapted to receive a screw top cover to seal the contents of the upper section therein. Integral with the first section is a cylindrical chamber recess depending therefrom and having a rectangular opening for slidingly rotatably receiving the second storage section therein. The second storage section being pivotally attached to the first storage section and adapted for storing and retaining an applicator therein.

17 Claims, 3 Drawing Sheets

COSMETIC JAR WITH PIVOTABLE PULL-OUT STORAGE DEVICE

BACKGROUND OF THE INVENTION

The present invention relates to a cosmetic jar for cosmetic preparations and in particular to a cosmetic jar having a pivotally attached hide away storage device for holding and retaining a cosmetic applicator or the like.

In general, a cosmetic jar or compact comprises a receptacle member for holding a given quantity of pressed powders, rouges, eye liners/eyebrow coloring, and the like as well as a cosmetic applicator therein. The cosmetic jar further comprises a cover member having an inner surface against which there may be attached a mirror, the receptacle member and cover member being either rotatably connected to one another by respective mating threads, i.e. in the manner of ajar and lid, or pivotally attached to one another at one cooperating edge thereof, i.e. in the manner of a clam.

Additionally, some cosmetic jars or compacts have incorporated a pull out drawer either within the cover or beneath the receptacle member. This drawer is used for holding and retaining the cosmetic applicator, brush or other cosmetic implementation device and in certain instances even a contraceptive device.

In the cosmetic compact disclosed in Lombardi, U.S. Pat. No. 5,836,319, a cosmetic compact is disclosed comprising an upper section having a cylindrical shell adapted to accommodate a cosmetic and adapted to screwingly receive a lid on the shell to thereby hermetically seal the cosmetic. Integrated with the upper section is a lower section defining a cylindrical chamber having an opening inlet to co-linearly admit a cylindrical pull-out drawer adapted to accommodate a mirror and an applicator for the cosmetic, such as a powder puff. The drawer being coupled to said lower section such that it can be entirely removed and separated from the shell thereby forming two discrete pieces. These two items together with the screw on cover and applicator pad leaves the consumer with four individual pieces to be held in two hands, thereby resulting in awkward and clumsy manipulation of the cosmetic compact by the consumer.

In the Yuhara U.S. Pat. No. 5,054,505 there is disclosed a facial compact having a storage space which can carry cosmetic related articles or unrelated articles. Specifically, Yuhara discloses a facial compact including a receptacle member having space for accommodating cosmetic material, a cover member pivotally connected to the receptacle member, a recess formed in the inner surface of the cover member defining a storage space, and a plate member slidably movable at a lower portion of the cover member and adapted to cover the storage space. Once again, like the drawer in the Lombardi reference, the plate is entirely removable from the cover member leaving the consumer with a number of individual pieces to juggle while attempting to apply the cosmetic powder.

One of the problems associated with the cosmetic jars and compacts discussed above is the actual number of separate individual pieces the compact becomes upon use by a consumer. During use by the consumer, the more separate individual pieces the compact becomes, the more difficult and awkward the process of applying the cosmetic becomes because the consumer is forced to apply the cosmetic with one hand and with the other hand attempt to balance and carry the several individual remaining pieces.

A related consideration is that, in all of the pull-out drawer compacts, the drawer has to be pulled out nearly to the point where the drawer separates from the rest of the compact in order to create a large enough opening to remove the applicator or brush therefrom. As is usually the case, the drawer in fact completely separates from the compact and falls either on to the floor or counter, or worse the drawer, which is covered with residual compact powder or the like, falls on to the consumers clothing thereby dirtying the consumer. Accordingly, ease of manipulation and use of the applicator is important to thereby reduce the possibility of its being inadvertently dropped by the user.

OBJECTS AND SUMMARY OF THE INVENTION

Accordingly, it is an object of the present invention to provide an improved cosmetic jar and storage device which is simple to use and at the same time convenient to use, i.e. retaining essentially the same, familiar look and feel of a conventional cosmetic jar.

Another object of the present invention is to provide an improved cosmetic jar and storage device having a decreased tendency for inadvertent soiling of clothing from accidental contact with the applicator or mishandling and dropping of the jar and its contents onto the consumers clothing.

Yet another object of the present invention is to provide a cosmetic jar and storage device made up of a relatively few number of parts which are detachable from one another.

Still another object of the present invention is to provide a cosmetic jar and storage device which is easy for the consumer to manipulate and use.

Finally, it is an object of the present invention to provide a cosmetic jar and storage device which is aesthetically pleasing in appearance to the consumer while still providing all of the essential functions desired by the consumer.

The above objects are accomplished, in one embodiment of the invention, by a combined cosmetic jar and applicator storage device comprising, a cylindrical body having a first body cosmetic storage section and a second applicator storage body section, the first body section being structured and arranged to accommodate a cosmetic such as a pressed powder or the like and adapted to theadingly receive a cover to thereby seal the contents of the first body section therein, the first body section further comprising a cylindrical chamber depending therefrom having a rectangular opening for slidingly rotatably receiving the second body section therein. The second body section being pivotally attached to the first body section thereby forming one unitary structure.

The combination is such that in each instance, the applicator, when stored, is maintained in a closed compartment which is separate and apart from that of the cosmetic compound. The applicator can be readily accessed by the consumer, by a simple procedure involving slidingly rotating the second body section from underneath the first body section of the jar, thereby exposing the applicator stored therein. Following use, the applicator is replaced within the second body section and the second body section rotatably and slidingly returned to its closed position beneath the first body section.

These and other objects, features and advantages of the present invention will become more apparent from the following description taken in conjunction with the accompanying drawings in which preferred embodiments of the present invention are shown by way of illustrative example.

BRIEF DESCRIPTION OF THE DRAWINGS

For a better understanding of the invention, as well as other objects and features thereof, reference is made to the accompanying drawings wherein.

DETAILED DESCRIPTION OF THE INVENTION

Figure 1:
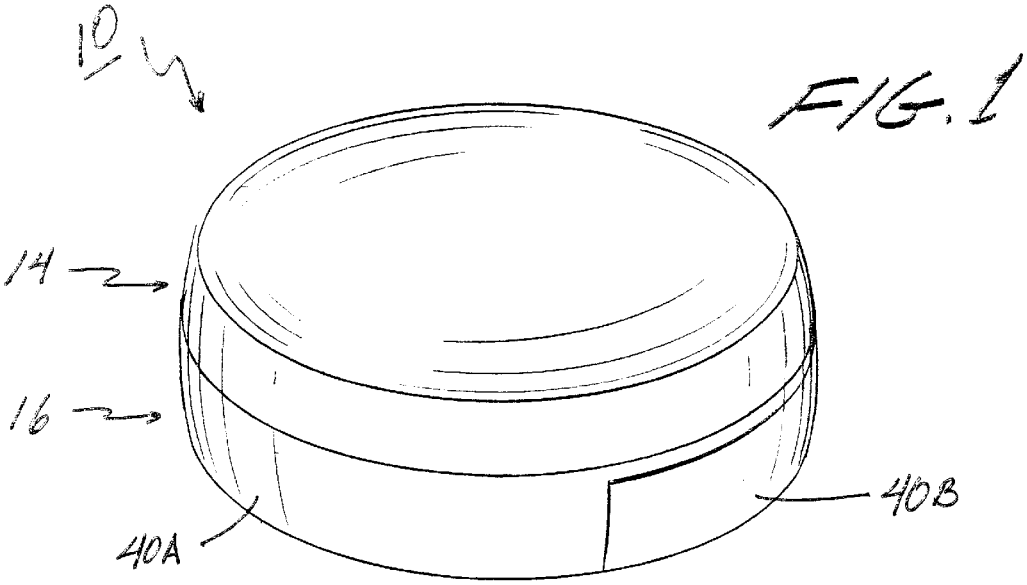
FIG. 1 is a top, front and right side perspective view of a cosmetic jar according to the present invention as it appears in a closed storage configuration.

Referring now to the Figures, in which like numbers refer to like parts, in accordance with the present invention there is provided a novel and improved cosmetic jar and applicator storage device generally designated by the numeral 10 having a cylindrical body comprising a first body portion 14 and a second body portion 16.

The first body portion 14 comprises a transverse bottom wall 18 (see FIGS. 4 and 5) having an annular or circular side wall 20 extending upwardly therefrom and spaced a distance from an outer edge 22 thereof, thereby defining a tub 24. On the exterior or outer periphery of the side wall 20 is a thread 26 adapted to threadingly receive a cover means 28, i.e. a screw cap or other threaded closure means. The tub 24 is adapted to receive a cosmetic material or substance such as cosmetic powder, talcum powder, creams, or the like therein (not shown). While a screw top closure means is depicted it should be noted that other cover means such as a cover which is pivotally attached at one point along the edge of the first body portion 14 can readily be used, i.e. much like a clam type cover.

Figure 2:
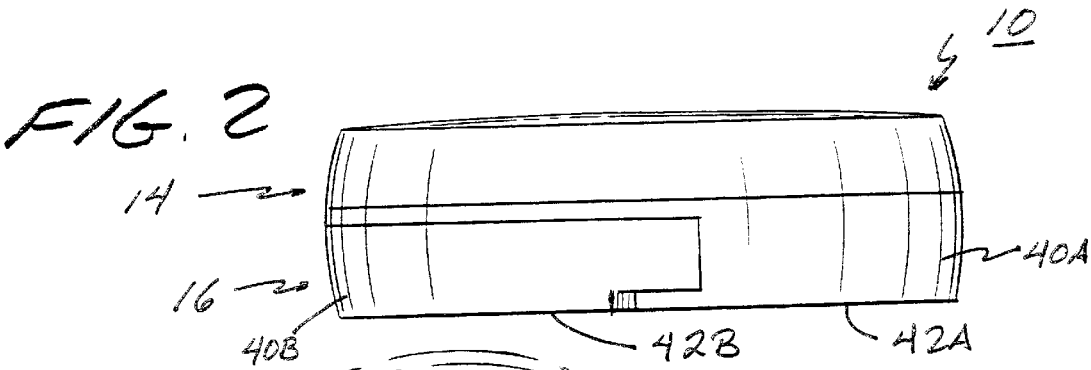
FIG. 2 is a rear elevational view of a cosmetic jar according to the present invention as it appears in a closed storage configuration.
Figure 3:
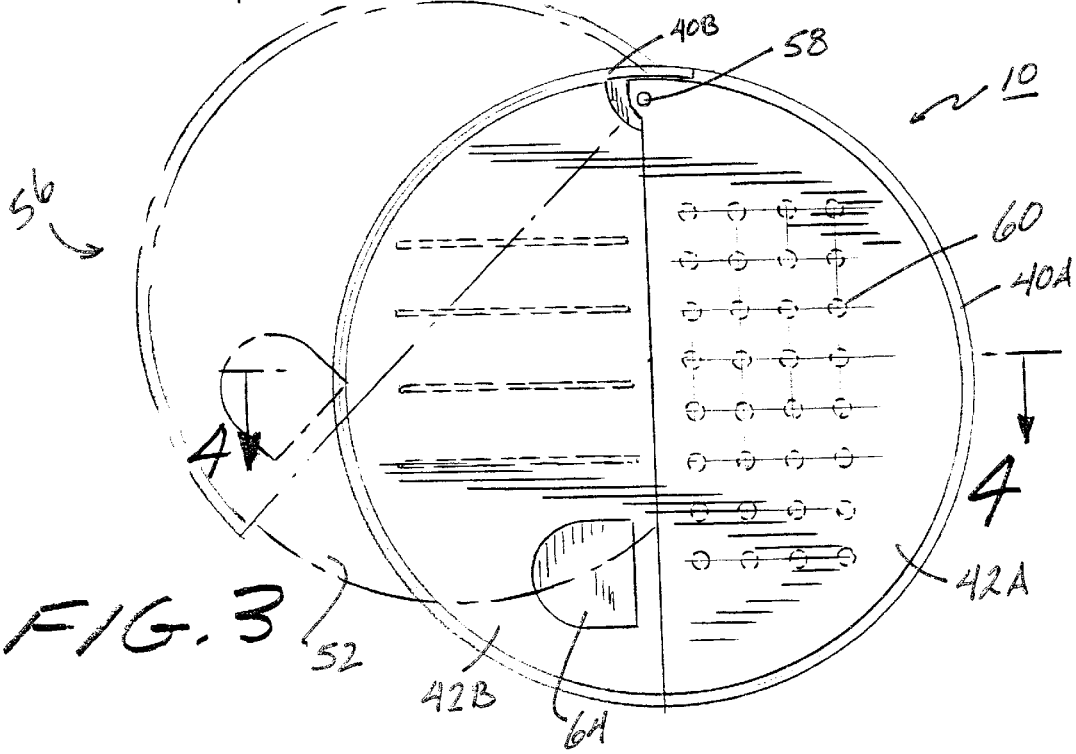
FIG. 3 is a bottom plan view of the cosmetic jar as it appears in a partially open configuration with a portion shown in phantom lines depicting the pivotal movement of the cosmetic tray.
Figure 4:
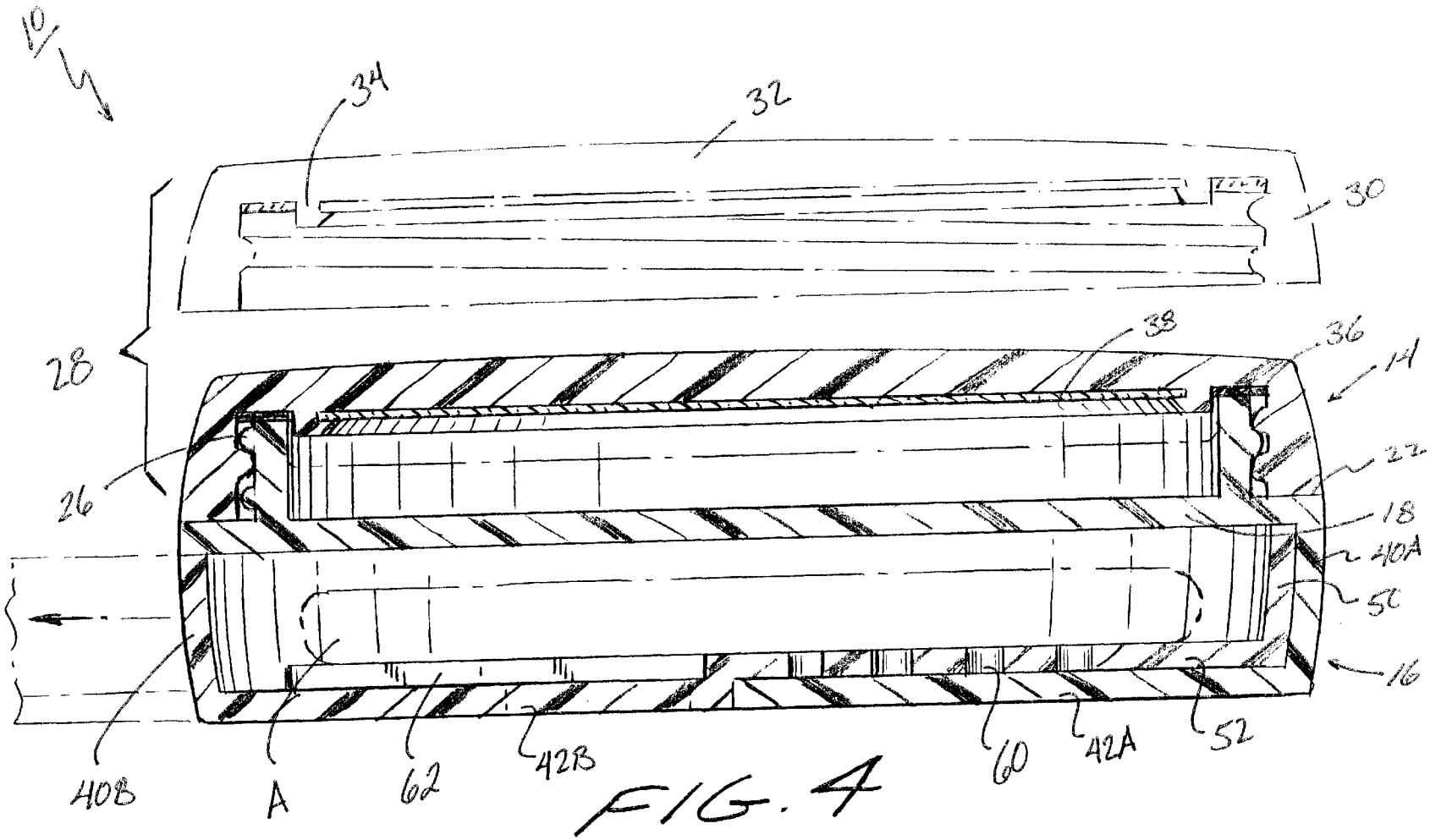
FIG. 4 is a side cross sectional elevation view taken along lines 4—4 of FIG. 3 with the cover in a removed configuration in shown in phantom lines.
Figure 5:
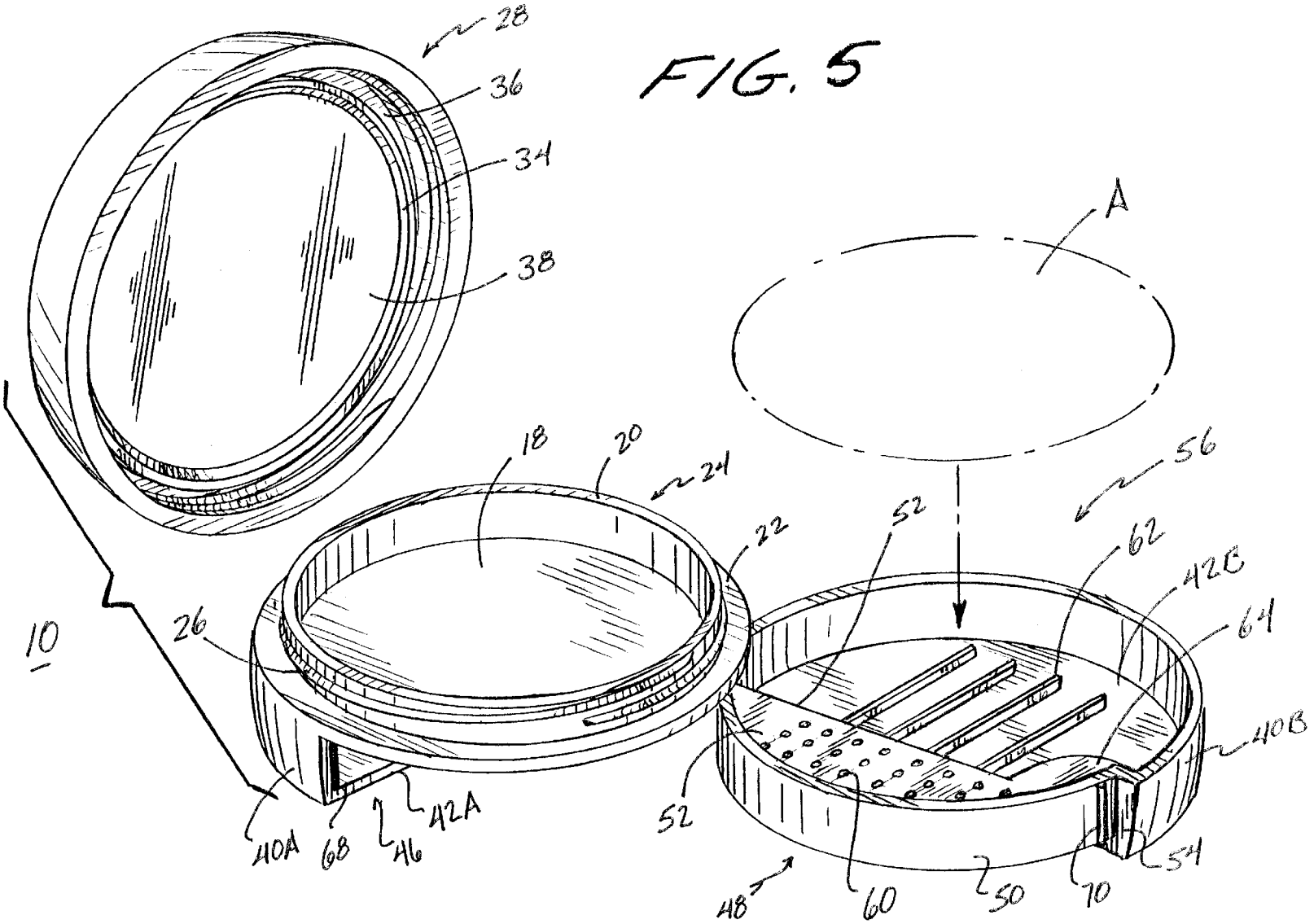
FIG. 5 is an exploded perspective view of the cosmetic jar according to the present invention as it appears in a fully open operative configuration.

As seen in FIGS. 4 and 5, the cover means 28 comprises an annular rim 30 and a back wall 32 connected to the rim 30. The rim 30 is adapted to threadingly cooperate with the thread 26 of the side wall 20. The back wall 32 comprises an annular ridge 34 on its inner surface spaced a distance from the rim 30. The annular ridge 34 is adapted to hold and retain an elastomeric ring 36, such as a compressible O-ring, between the rim 30 and the ridge 34. In use, when the cover means 28 is screwed on to the first body portion 14, the ring 36 comes to rest against the upper edge of the annular side wall 20. In this manner, the ring 36 acts to prevent volatile agents included in the cosmetic substance stored in the tub 24 of the first body portion 14 from evaporating when the jar 10 in closed, as seen in FIGS. 1, 2 and 4. In addition, the ridge 34 is adapted to retain and hold a reflective material 38, i.e. a mirror, against the back wall 32 of the cover means 28, thereby providing the consumer with a portable mirror to aid in the application of the cosmetic product stored within the cosmetic jar 10.

Integral with the first body portion 14 is a semi-cylindrical chamber 44, depending therefrom, having an annular chamber wall 40A extending downwardly from the outer edge 22 of the bottom wall 18 and terminating in a chamber base wall 42A. The annular chamber wall 40A and the chamber base wall 42A terminate substantially along a diameter of the first and second body portions 14 and 16, thereby defining along the diameter of the cosmetic jar 10 a rectangular opening 46.

The second body portion 16 further comprises a tray 56 pivotally attached along the diameter of the cosmetic jar 10 at a point substantially near the edge 22. The tray 56 comprises an annular tray wall 40B terminating in a tray base 42B. The tray wall 40B and tray base 42B terminate substantially along the diameter of the first and second body portions 14 and 16 respectively. The annular tray wall 40B has a height substantially equal to the height of the annular chamber wall 40A. In this manner when the chamber wall 40A and the chamber base 42A abut against the tray wall 40B and the tray base 42B, the annular side walls 40A and 40B and the base walls 42A and 42B are flush with one another.

Integral with the tray wall 40B and the tray base 42B is a platform 48 comprising an annular platform side wall 50 and a platform base wall 52 integrally connected to the lower edge thereof. The outside diameter of the annular platform sidewall 50 is of a slightly smaller diameter than the inside diameter of annular chamber wall 40B and the height of the platform sidewall 50 is slightly smaller than the height of the rectangular opening 46. The annular platform side wall 50 and platform base wall 52 are joined to the tray side wall 40B and the tray base wall 42B respectively by a shoulder 54. The shoulder 54 having a thickness substantially equal to the thickness of the annular chamber wall 40A and the annular base wall 42A. In this manner, the platform 48 is dimensioned such that the platform 48 is slidingly capable of being inserted through the rectangular opening 46 into the semi-cylindrical chamber 44.

The second body portion 16 is pivotally attached to the first body portion 14 by a pivot pin 58 passing through the chamber base wall 42A of the first body portion 14 and the annular platform side wall 50 of the second body portion 16 into the bottom wall 18. The pin being located at a tangential edge of the diameter dividing line between the annular chamber wall and the annular tray wall 40A and 40B respectively and the chamber base wall and the tray base walls 42A and 42B respectively.

The tray 56 further comprises a plurality of evenly spaced ventilation holes 60 formed in the supporting base member 52 for aiding in the drying of a cosmetic applicator A placed thereon for storage in the tray 56. A plurality of ribs 62 extending from the shoulder 54 are integrally formed on the top surface of the second base wall 42B. The ribs 62 have a height substantially equal to the height of the shoulder 54 in order to be flush with the top surface of the supporting base member 52 of the tray 56. In this manner, an applicator A placed within the tray 56 for storage will remain generally supported from underneath throughout the tray 56.

In this manner, the compact jar 10 has two modes of use, a closed storage mode and an open application mode. In the closed storage mode the second body portion 16 is rotated about pivot pin 58 such that the annular side wall 50 and supporting base wall 52 of tray 56 are slidingly rotated to be inserted through the rectangular opening 46 into the circular chamber 44. The second body portion 16 is rotated until the shoulder 54 contacts and abuts the terminal edges of the of the first annular side wall 40A and the first base wall 42A and the platform 48 rests within the semi-cylindrical chamber 44. In the closed storage mode, the overall shape of the lower storage section 16 corresponds to the cylindrical body of the cosmetic jar 10.

In the open application mode, the second body portion 6 is slidingly rotated about pivot pin 58 such that platform 48 is drawn entirely out from the semi-cylindrical chamber 44 thereby completely exposing the tray 56. The pivot pin 58 ensures that the second body portion 16 remains attached to the first body portion 14 at all times while simultaneously permitting exposure of the entirety of the tray 56 and its contents. In this manner, the consumer can hold the cosmetic jar 10 while having the storage space of the tray 56 completely exposed and accessible without fear that the second body portion 16 will separate from the first body portion 14 thus spilling its contents onto their clothing.

Moreover, the second body portion 16 is rotatable to a position wherein the first body portion 14 covers no portion of the tray 56 other than the a common coupling point where the two are pivotally connected to one another. In this manner, the applicator A stored within the tray 56 of the second body portion 16 can be readily removed therefrom without having to twist or bend the applicator and without the fear that the second body portion 16 is only tenuously connected to the first body portion 14 and subject to detachment or separation at any moment.

In operation, the cosmetic jar 10 is retained in the closed storage mode when not in use. In this mode the cosmetic jar 10 can be stored in the consumers purse, handbag, pocket or on a shelf. When the consumer desires to apply the contents of the cosmetic jar 10, they simply hold the jar 10 in one hand while simultaneously slidably rotating the second body portion 16 co-planarly with respect to the first body portion 14, thereby exposing the tray 56 and the applicator A stored therein. The consumer is now free to remove the applicator A from the tray 56 and since the tray 56 is fully supported by pivot pin 58, the consumer is free to forget about the possibility of the second body portion 16 separating from the first body portion 14 while applying the cosmetic. When the consumer is through applying the cosmetic, the consumer returns the applicator A to the tray 56 and slidably rotates the platform 48 back into the circular chamber 44 thereby returning the second body portion 16 to its storage mode beneath the first body portion 14.

The bottom surface of the tray base wall 42B is further provided with a finger recess 64 for aiding the consumer in slidably rotating the second body portion 16 from beneath the first body portion 14. Closing means are provided for maintaining the second body portion 16 in the closed storage position when not in use by the consumer thereby preventing the contents of the tray 56 from becoming lost or misplaced. The closing means comprise a first tooth 68 formed on the inner surface of the annular chamber wall 40A, opposite the location of the pivot pin 58, extending radially inward and a second tooth 70 formed on the outer surface of annular side wall 50, spaced a distance from the shoulder 54, opposite the location of the pivot pin 58, extending radially outward therefrom. In use, the teeth 68 and 70 snappingly engage one another when the second body portion 16 is slidingly rotated into the closed storage mode.

Although certain preferred embodiments have been shown and described, it should be understood that many changes and modifications may be made thereto without departing from the scope of the appended claims.

What is claimed is:

1. A combination cosmetic jar and applicator storage device comprising:

a first cylindrical storage body portion; and a second cylindrical storage body portion pivotally attached to said first cylindrical storage body portion and rotatable between a first closed position wherein said second body portion is substantially disposed beneath said first body portion and a second open position wherein said second body portion is slidingly rotated about a pivot point to said second position in which said second body portion is substantially exposed from beneath said first body portion, wherein said first cylindrical storage body portion further comprises:

a semi-cylindrical chamber depending therefrom, said chamber structured and arranged to receive said second body portion therein when said second body portion is rotated to said first closed position, said chamber having an annular chamber side wall extending downwardly from said first cylindrical body portion and a chamber base wall connected to a lower edge of said chamber side wall, said chamber side wall and chamber base wall terminating along a diameter of said cosmetic jar, said first body portion, chamber side wall and chamber base wall bounding a rectangular opening for passage of said second body portion therethrough and into said chamber for seating therein, and wherein said second body portion defines a tray comprising:

an annular tray wall and a tray base wall connected to a lower edge of said tray wall, said annular tray wall and said tray base wall terminating along said diameter of said cosmetic jar; and a platform section integrally connected to said annular tray wall and said tray base wall, said platform having an annular platform side wall and a platform base wall connected to a lower edge of said platform side wall, said annular platform side wall having an outside diameter substantially equal to an inside diameter of said annular chamber side wall and a height substantially equal to a height of said rectangular opening, whereby a shoulder is formed between said annular tray wall and said annular platform wall and between said tray base wall and said platform base wall respectively, such that said platform is structured and arranged to be slidingly rotatable insertable within said semi-cylindrical chamber when said second body potion is rotated to said first closed position.

2. The cosmetic jar and applicator storage device according to claim 1, wherein said second body portion is pivotally connected to said first body portion by a pivot pin structured and arranged to pass through said chamber base wall, said annular tray wall and into said first body portion, whereby said second body portion co-planarly rotates about said pivot pin with respect to said first body portion, said pivot pin being substantially co-linear with said terminal edge of said annular chamber side wall and said chamber base wall.

3. The cosmetic jar and applicator storage device according to claim 2, wherein said second body portion further comprises:

a plurality of ventilation holes formed in said base wall of said platform section.

4. The cosmetic jar and applicator storage device according to claim 2, wherein said second body portion further comprises:

a plurality of ribs integrally connected to an inner top surface of said tray base wall and extending vertically upward therefrom; said ribs terminating substantially even with an inner top surface of said platform base wall.

5. The cosmetic jar and applicator storage device according to claim 2, wherein said second body portion further comprises:

a finger recess formed in said tray base wall, said finger recess located opposite said pivot pin whereby said finger recess assists a user in rotatably sliding said second body portion about said pivot pin.

6. The cosmetic jar and applicator storage device according to claim 2, further comprising:

locking means for ensuring said tray remains seated within said cylindrical chamber.

7. The cosmetic jar and applicator storage device according to claim 6, wherein said locking means comprises a first tooth extending radially inward from said terminal edge of said annular chamber wall opposite said pivot pin location; and a second tooth extending radially outward from said annular platform spaced a distance from said shoulder and located opposite said pivot pin location, whereby said first and second tooth snappingly engage when said second body portion is slidingly pivoted between said first closed position and said second open position.

8. The cosmetic jar and applicator storage device according to claim 1, wherein said first body portion comprises:

a circular bottom wall;

an annular side wall extending upwardly from said bottom wall and spaced a distance from a terminal edge of said bottom wall; and cover means for closing said upper storage section.

9. The cosmetic jar and applicator storage device according to claim 8, wherein said cover means threadingly engages said annular side wall.

10. The cosmetic jar and applicator storage device according to claim 8, wherein said cover means comprises:

an annular rim interconnected by a back wall;

an elastomeric ring disposed on an inner surface of said back wall for engaging an upper edge of said annular side wall of said first body portion.

11. The cosmetic jar and applicator storage device according to claim 1, wherein said shoulder is substantially equal to the thickness of said annular chamber wall and said chamber base wall, whereby when said tray is in said first closed position said annular chamber wall is flush with said annular tray wall and said chamber base wall is flush with said tray base wall.

12. A portable combination cosmetic jar and applicator storage device for carrying on an individual, the combination cosmetic jar and applicator device comprising:

a first cylindrical storage body portion structured and arranged for storing and retaining a cosmetic compound therein; and a second cylindrical storage body portion structured and arranged for storing and retaining a cosmetic applicator separate from said cosmetic compound, wherein said second cylindrical storage body portion is pivotally attached to said first cylindrical storage body portion and rotatable between a first closed position wherein said second body portion is substantially disposed beneath said first body portion and a second open position wherein said second body portion is slidingly rotated about a pivot point to said second position in which said second body portion is substantially exposed from beneath said first body portion;

an annular chamber side wall extending downwardly from said first cylindrical body portion, and a chamber base wall connected to a lower edge of said annular chamber side wall, said annular chamber side wall and chamber base wall terminating along a mid-line of said cosmetic jar, said first body portion, annular chamber side wall and chamber base wall bounding a rectangular opening for passage of said second body portion therethrough and into said first cylindrical body portion.

13. The cosmetic jar and applicator storage device according to claim 12, wherein said second body portion defines a tray comprising:

annular tray wall;

a tray base wall connected to a lower edge of said tray wall, said annular tray wall and said tray base wall terminating along a mid-line of said cosmetic jar; and a platform section integrally connected to said annular tray wall and said tray base wall, said platform having an annular platform side wall and a platform base wall connected to a lower edge of said platform side wall.

14. The cosmetic jar and applicator storage device according to claim 13, wherein said annular platform side wall has an outside diameter substantially equal to an inside diameter of said annular chamber side wall and a height substantially equal to a height of said rectangular opening, wherein a shoulder is formed between said annular tray wall and said annular platform wall and between said tray base wall and said platform base wall respectively, such that said platform is structured and arranged to be slidingly rotatably insertable within said first cylindrical storage body portion when said second body potion is rotated to said first closed position.

15. A combination cosmetic jar and applicator storage device comprising: a first storage body portion having an upper cylindrical receiving chamber for storing a cosmetic compound, and a lower semi-cylindrical receiving chamber integral with and depending from said upper cylindrical receiving chamber, said upper and lower chambers being separated by a intermediate dividing wall; and a second storage body portion structured and arranged for storing a cosmetic applicator on a perforated bottom wall thereof, said second storage body portion being pivotally attached to said first storage body portion and rotatable between a first closed position wherein said second body portion is retained within said semi-cylindrical receiving chamber of said first body portion and a second open position in which said second body portion is substantially removed from within said semi-cylindrical receiving chamber of said first body portion.

16. The cosmetic jar and applicator storage device according to claim 15, wherein said semi-cylindrical chamber is structured and arranged to receive said second body portion therein when said second body portion is rotated to said first closed position, said semi-cylindrical chamber having an annular chamber side wall and a semi-circular chamber base wall connected to a lower edge of said semi-cylindrical chamber side wall, said semi-cylindrical chamber side wall and semi-circular chamber base wall terminating along a diameter of said cosmetic jar; said intermediate dividing wall, semi-cylindrical chamber side wall and semi-circular chamber base wall bounding a rectangular opening for passage of said second body portion therethrough and into said semi-cylindrical chamber for seating therein.

17. The cosmetic jar and applicator storage device according to claim 15, wherein said second body portion defines a tray comprising:

an annular tray side wall and a tray base wall connected to a lower edge of said annular tray side wall, said annular tray side wall and said tray base wall terminating along a diameter of said cosmetic jar; and a platform section integrally connected to said annular tray side wall and said tray base wall, said platform having an annular platform side wall and a platform base wall connected to a lower edge of said platform side wall, said annular platform side wall having an outside diameter substantially equal to an inside diameter of said lower semi-cylindrical receiving chamber and a height substantially equal to a height of said lower semi-cylindrical receiving chamber, wherein a shoulder is formed between said annular tray side wall and said annular platform wall and between said tray base wall and said platform base wall respectively, such that said platform is adapted to be slidingly rotatably insertable within said semi-cylindrical chamber when said second body potion is rotated to said first closed position.

* * * * *